US010683144B2

(12) United States Patent
Klapper et al.

(10) Patent No.: US 10,683,144 B2
(45) Date of Patent: Jun. 16, 2020

(54) CAP ASSEMBLY FOR MULTI SIZE BOTTLE NECKS

(71) Applicant: BOTTLE DRAINER LLC, Scarsdale, NY (US)

(72) Inventors: Jay A. Klapper, Teaneck, NJ (US); Michael Klapper, Scarsdale, NY (US)

(73) Assignee: BOTTLE DRAINER LLC, Scarsdale, NY (US)

( * ) Notice: Subject to any disclaimer, the term of this patent is extended or adjusted under 35 U.S.C. 154(b) by 109 days.

(21) Appl. No.: 15/911,791

(22) Filed: Mar. 5, 2018

(65) Prior Publication Data

US 2018/0251269 A1 Sep. 6, 2018

Related U.S. Application Data

(60) Provisional application No. 62/467,296, filed on Mar. 6, 2017.

(51) Int. Cl.

| | |
|---|---|
| ***B65D 41/04*** | (2006.01) |
| ***B65D 1/02*** | (2006.01) |
| ***B65D 51/00*** | (2006.01) |
| ***B65D 51/24*** | (2006.01) |
| ***B65D 47/08*** | (2006.01) |

(52) U.S. Cl.

CPC ..... *B65D 41/0428* (2013.01); *B65D 1/0223* (2013.01); *B65D 41/0414* (2013.01); *B65D 41/0471* (2013.01); *B65D 47/0885* (2013.01); *B65D 51/00* (2013.01); *B65D 51/249* (2013.01); *B65D 2251/08* (2013.01)

(58) Field of Classification Search

CPC ..... B65D 41/0428; B65D 1/0223; B65D 41/0471; B65D 41/0414; B65D 2251/08

USPC ..... 220/287, 521–523; 215/228; 222/556, 222/562

See application file for complete search history.

(56) References Cited

U.S. PATENT DOCUMENTS 5,094,361 A * 3/1992 Dubach ..... B65D 47/36 215/235
5,104,013 A * 4/1992 Hawley ..... B65D 35/38 222/566
5,248,071 A * 9/1993 Ray ..... B65D 47/122 222/566

(Continued)

FOREIGN PATENT DOCUMENTS

CN 105745171 A 7/2016

*Primary Examiner* — James N Smalley
(74) *Attorney, Agent, or Firm* — Epstein Drangel LLP; Robert L. Epstein

(57) ABSTRACT

A cap assembly for use with multiple bottles having different size necks is provided. The assembly includes a base, at least one adapter and a lid. The base includes a compartment for storing the adapter and an opening having at least two internally threaded sections of different size and a port. The adapter includes an internally threaded opening having at least two sections of different size and an externally threaded surface having at least two sections of different size. The lid is mounted on the base for movement between a position wherein the base opening port is closed and a position wherein the base opening port is open. Additional adapters may be included. The additional adapters are configured to accept bottle necks of different sizes than the base opening and first adapter such that at least six bottles with different size necks can be used with the assembly.

29 Claims, 10 Drawing Sheets

(56) References Cited

U.S. PATENT DOCUMENTS

| | | | | |
|---|---|---|---|---|
| 6,095,374 | A | 8/2000 | Ricard et al. | |
| 6,390,315 | B1 * | 5/2002 | Giddings | B65D 47/088 215/235 |
| 6,877,626 | B2 | 4/2005 | Sherrod | |
| 8,950,608 | B2 | 2/2015 | Dejong et al. | |
| 2003/0178433 | A1 * | 9/2003 | Adams | B65D 47/0895 220/703 |
| 2005/0184024 | A1 | 8/2005 | Santa Cruz et al. | |
| 2006/0201900 | A1 | 9/2006 | De Francesco | |
| 2008/0251486 | A1 | 10/2008 | Housley et al. | |
| 2011/0121102 | A1 * | 5/2011 | Clarke | B05B 7/2408 239/318 |
| 2012/0024903 | A1 | 2/2012 | Leith, Sr. et al. | |
| 2013/0056505 | A1 | 3/2013 | Cress | |

* cited by examiner

CAP ASSEMBLY FOR MULTI SIZE BOTTLE NECKS

CROSS-REFERENCE TO RELATED APPLICATIONS

Priority is claimed on Provisional Patent Application Ser. No. 62/467,296, filed Mar. 6, 2017, which is incorporated herein in its entirety by reference.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to dispensers for bottles of viscous products and more particularly to a cap assembly which can be used as a product dispenser for multiple bottles of different neck sizes.

2. Description of Prior Art Including Information Disclosed Under 37 CFR 1.97 and 1.98

A problem which many people have with bottles containing viscous liquid products, particularly bottles with pump type dispensers, is getting the last third of the contents out of the bottle. As a result, a large portion of the product is wasted. That may be caused by the tube of the pump dispenser not reaching the product at the bottom of the bottle, because flipping the bottle upside down and holding the bottle until the product reaches the opening for removal can take a very long time, or because the cap is too small to keep the bottle inverted on its own and it topples over. This occurs repeatedly, and is frustrating and wasteful—wasting both time and money.

The present invention overcomes this problems by removing the pump dispenser or small cap from the top of the bottle and replace it with a larger dispensing cap assembly. The bottle with the cap assembly is then and turned upside down (inverted) so the cap now becomes a stable base for the bottle to stand upside down on its own, enabling all of the product in the bottle to flow toward the cap assembly through gravity such that the product is always ready for immediate dispensing as needed, until every last drop is gone.

Most inversion caps are designed to fit only one size threaded bottle neck at a time. They may be supplied with one or more loose parts which allow the cap to accommodate different size bottle necks. They may also have many external, temporary, multi-sized gaskets that need constant replacement and still do not adequately prevent product leakage—making it difficult, complex and frustrating for the user.

The parts and pieces can easily be lost, rendering the inversion cap useless for a particular size bottle in the future.

They also don't have parts for every popular size threaded bottle neck or the ability to accommodate snap-in type bottle necks.

Our invention is an improved cap assembly including a base which has a two section internally threaded base opening adapted to accept one of two different size externally threaded bottle necks with one motion making it easy for sizing. Within the same cap base, compartments for storing two additional two section, dual diameter adapters which can be received in the base opening, each adapted to receive two other bottle necks of different size, thus accommodating at least six of the most popular bottle neck sizes world-wide.

The structure of the base and adapters of our invention decreases the number of adapters which would otherwise be required to accommodate at least six different bottle size necks by more than half and increases the number of bottle neck choices. The adapters are securely stored within the cap assembly base itself making for easy accessibility when needed, and greatly reduces the chances that any of the adapters may be lost. Further, in situations where additional parts such as gaskets are provided, the additional parts can be stored in the base, as well.

It is therefore a prime object of the present invention to provide a cap assembly which can be used with bottles having different size bottle necks.

It is another object of the present invention to provide a cap assembly for multi size bottle necks which can accept an inverted bottle such that the entire contents of the bottle can be dispensed.

It is another object of the present invention to provide a cap assembly for multi size bottle necks which includes a base adapted to accept an inverted bottle.

It is another object of the present invention to provide a cap assembly for multi size bottle necks which includes a base that is stable on flat or wire surfaces.

It is another object of the present invention to provide a cap assembly for multi size bottle necks which includes at least two adapters.

It is another object of the present invention to provide a cap assembly for multi size bottle necks which includes a base with storage compartments for the adapters.

It is another object of the present invention to provide a cap assembly for multi size bottle necks which is capable of accepting bottles having at least six different size bottle necks.

BRIEF SUMMARY OF THE INVENTION

The above noted objects are achieved by the present invention which relates to a cap assembly for use with multiple bottles having different size necks. The assembly includes a base, at least one adapter and a lid.

The base includes an opening having at least two internally threaded sections of different sizes to accommodate bottles of two different size necks, or an adapter. The base also includes a compartment for storing at least one adapter.

Each adapter includes an internally threaded opening having at least two different size sections. The adapter also includes an externally threaded surface having at least two different size sections.

The lid is mounted on the base for movement between a position wherein the base opening is closed such that the contents of the bottle attached to the base cannot exit the base and a position wherein the base opening is open such that the contents of the bottle attached to the cap assembly may exit the base.

The sizes of the base opening sections are different from the sizes of the internally threaded sections of the adapter opening.

The assembly further includes a second adapter. The second adapter includes an internally threaded opening having at least two sections of different sizes. The second adapter also has an externally threaded surface having at least two sections of different sizes.

The sizes of the base opening sections, the sizes of the internally threaded sections of the adapter opening and the sizes of the internally threaded sections of the second adapter opening are all different from each other.

The base includes a second compartment for storing the second adapter.

The base opening includes a port. A funnel extends between the internally threaded sections of the base opening and the port to guide the contents of the bottle from the bottle to the port.

The lid has a protrusion. The lid protrusion is received in the port in the closed position of the lid. The protrusion seals the port when the lid is in the closed position. The protrusion is tightly received in the port such that the lid tends to remain the closed position.

The lid includes a recess. The base has a part adapted to be received in the lid recess in order to retain the lid in its open position.

The cap assembly has a hinge for connecting the lid and the base.

The cap assembly further includes at least one member in the base compartment which is adapted to engage an adapter situated in the compartment.

The base has a substantially cylindrical side wall surface and a substantially flat top surface. The base side wall surface and the base top surface are connected by an arcuate surface.

The lid has a part which is accessible from the exterior of the base when the lid is in the closed position.

In accordance with another aspect of the present invention, a cap assembly adapted for use with at least four bottles having different size necks is provided. The assembly includes a base, at least one adapter and a lid. The base has an opening with at least two internally threaded sections of different sizes to accommodate bottles of two different size necks, or an adapter. The base also includes a compartment for storing at least one adapter.

The at least one adapter includes an internally threaded opening having at least two different size sections adapted to receive two other bottles. The adapter also includes an externally threaded surface having at least two sections of different size such that the adapter can be received in the base opening.

The lid is mounted on the base for movement between a position wherein the base opening is closed and a position wherein the base opening is open.

In accordance with another aspect of the present invention, a cap assembly adapted for use with at least six bottles having different size necks is provided. The assembly includes a base, an adapter, a second adapter and a lid.

The base includes an opening having at least two internally threaded sections of different sizes adapted to receive two of the bottles. The base also has compartments for storing each adapter.

Each adapter includes an internally threaded opening having at least two sections of different sizes. The first adapter is adapted to receive two other bottles. The second adapter includes an internally threaded opening having at least two sections of different size adapted to receive the remaining two bottles. Additional adapters including an internally threaded opening having at least two sections of different sizes may be provided to accommodate additional bottles.

Each adapter also includes an externally threaded surface having at least two sections of different size such that each adapter can be received in the base opening.

The lid is mounted on the base for movement between a position wherein the base opening is closed and a position wherein the base opening is open.

BRIEF DESCRIPTION OF THE SEVERAL VIEWS OF DRAWINGS

To these and to such other objects that may hereinafter appears, the present invention relates to a cap assembly for multi size bottle necks as described in detail in the following specification and recited in the annexed claims, taken together with the accompanying drawings, in which like numerals refer to like parts and in which:

DETAILED DESCRIPTION OF THE INVENTION

Figure 1:
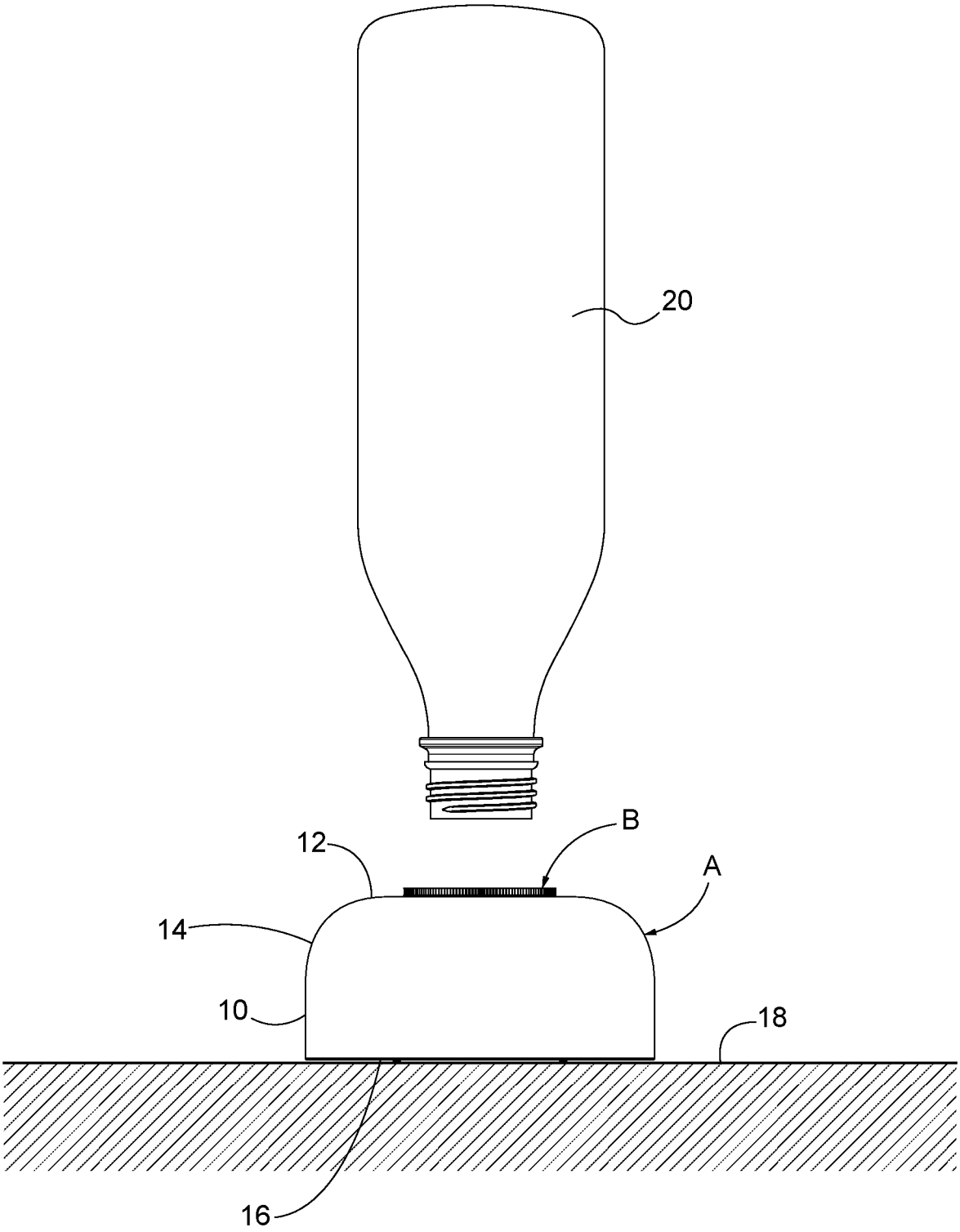
FIG. 1 is an exploded view of the base of the cap assembly of the present invention resting on a horizontal surface and a bottle, before the bottle is received in the adapter situated in the base opening.

Throughout this disclosure the word "threaded" is used to describe the contours of the base opening and of the adapter surfaces. The term "threaded" is intended to include a single helical thread commonly found on bottles with rotatable screw caps as well as one or more horizontally extending spaced parallel ribs commonly used on "snap-on" caps.

Further, the word "size" is used to describe the outer diameter of a bottle neck or the internal or external diameter of the surface of an adapter or base opening.

The present invention relates to a cap assembly for use with multiple bottles having different size necks. The cap assembly includes a base, generally designated A, at least one adapter, generally designated B, and a lid, generally designated C. In the preferred embodiment illustrated in the drawings two adapters B1 and B2 are provided.

As seen in FIG. 1, base A has a cylindrical side wall surface 10 and a top surface with a flat surface portion 12 with an arcuate corner surface 14 therebetween. The bottom 16 of the base is flat and designed to rest on a horizontal surface 18 in a stable manner.

Prior to placing base A on surface 18, the base is placed over a bottle 20 which is in the upright position. The cap assembly is rotated relative to the bottle. The base with the bottle attached is then inverted into the position of the base shown in FIG. 1.

Figure 2:
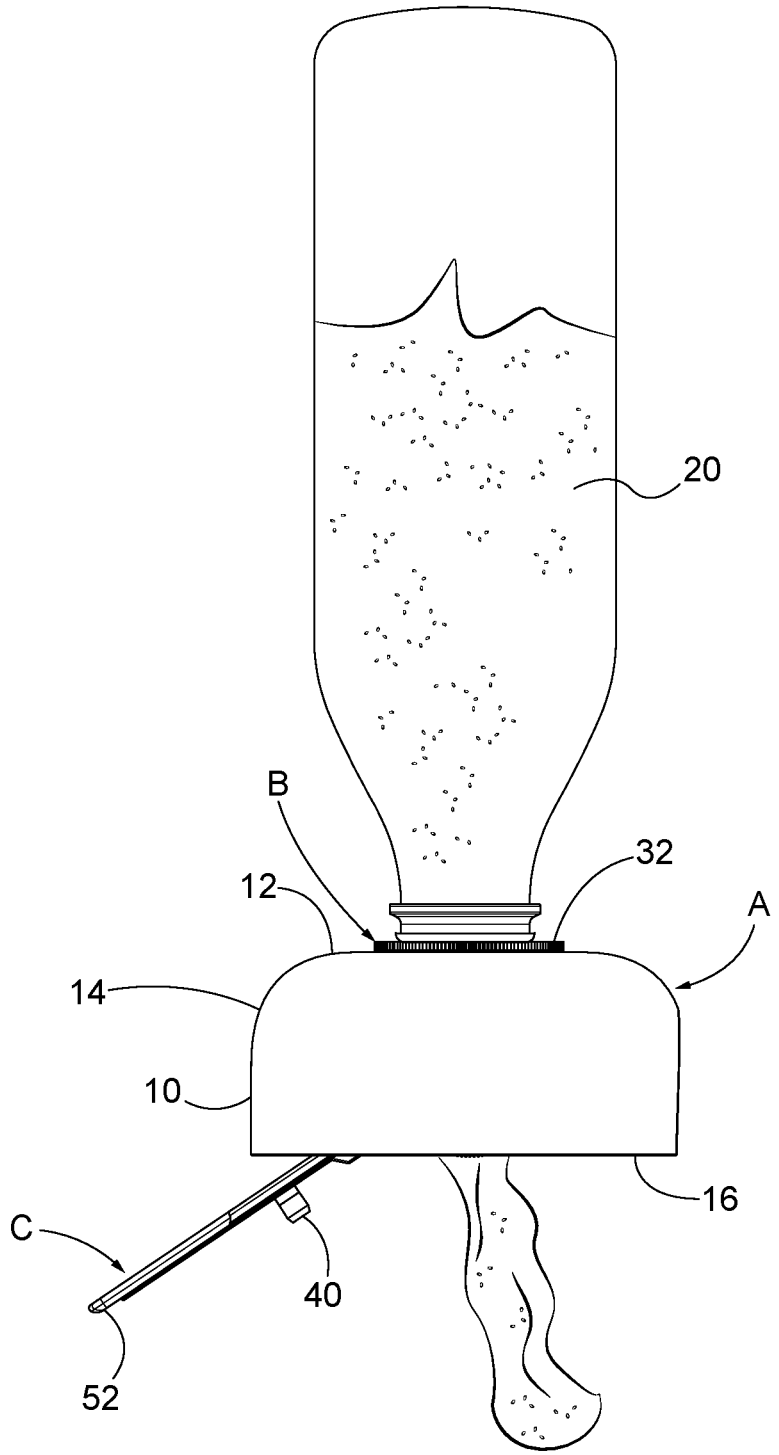
FIG. 2 is a view similar to FIG. 1 showing the base with the bottle received in the adapter situated in the base opening and the lid in the open position allowing the contents of the bottle to flow from the cap assembly.

FIG. 2 shows the bottle attached to the base removed from surface 18. Lid C of the base is moved to its open position so that the contents of the bottle can flow from the bottle and exit the bottom 16 of the base.

Figure 3:
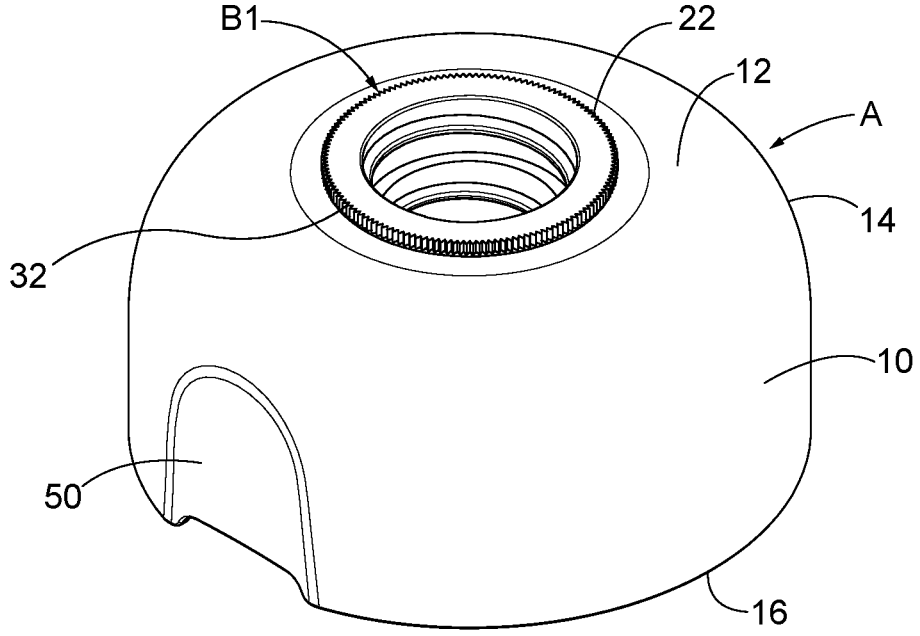
FIG. 3 is a perspective view of the base of the cap assembly.
Figure 4:
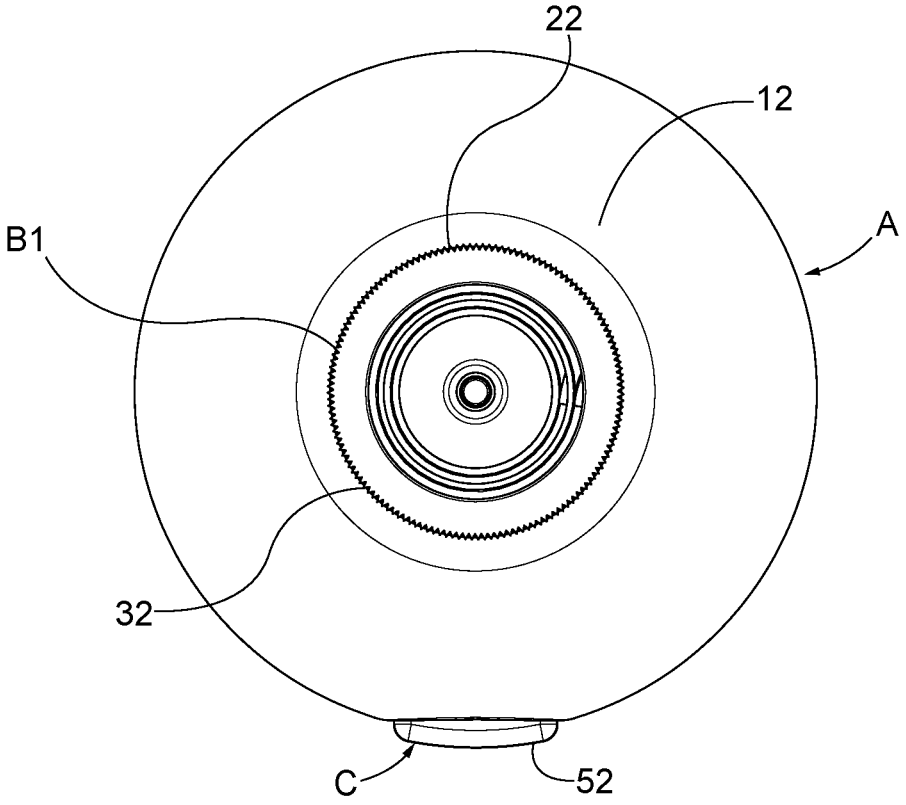
FIG. 4 is a top plan view of the base of the cap assembly.
Figure 5:
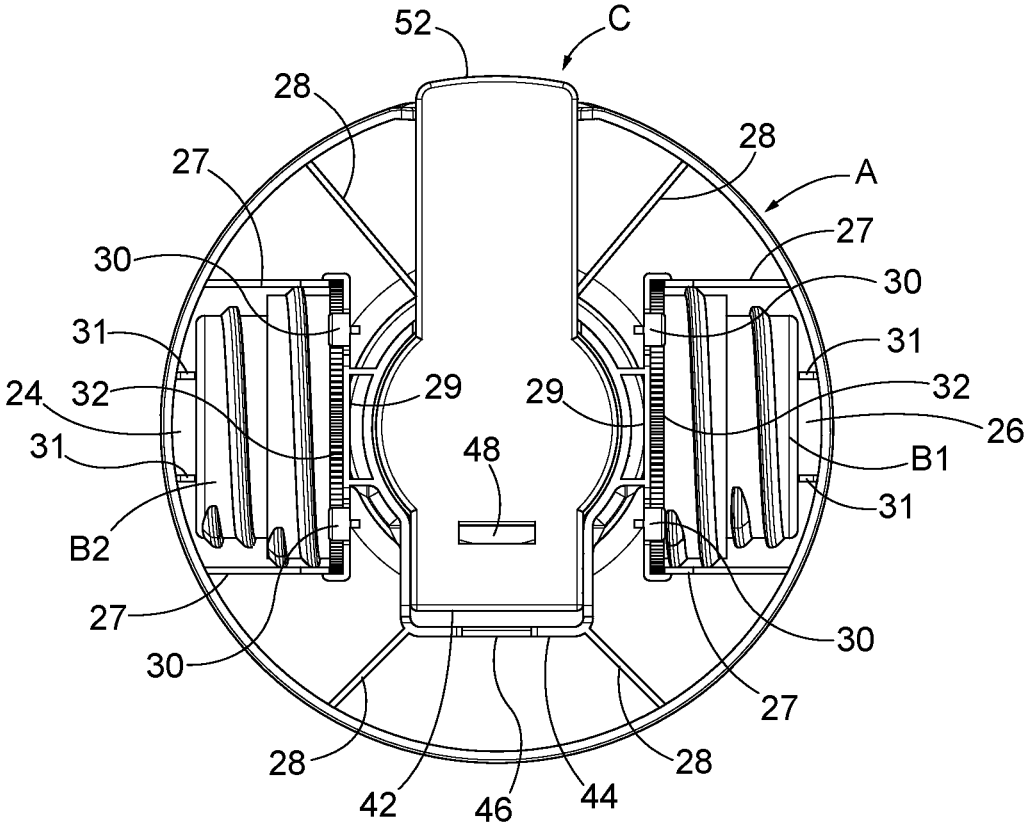
FIG. 5 is a bottom plan view of the base of the cap assembly showing the adapters stored in the base storage compartments and the lid in its closed position.
Figure 16:
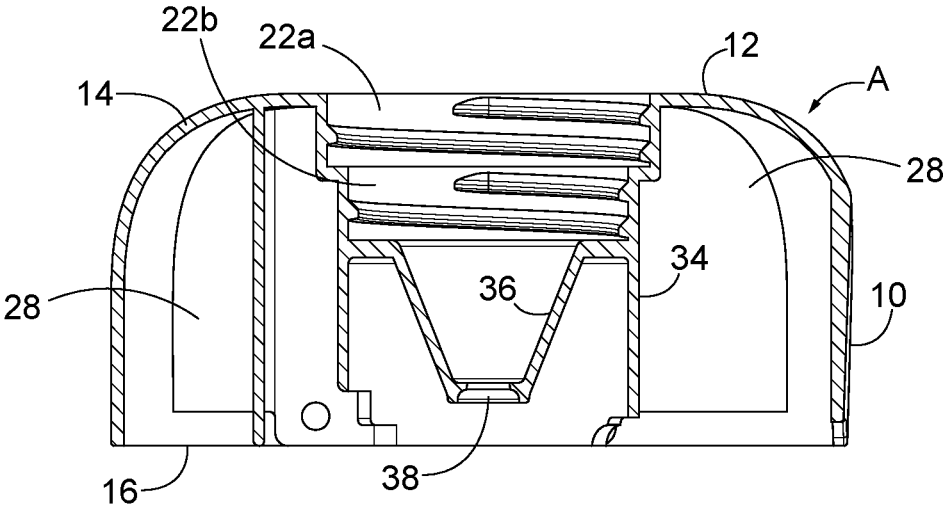
FIG. 16 is a cross-sectional view of the base in the inverted position without any adapter or lid.
Figure 18:
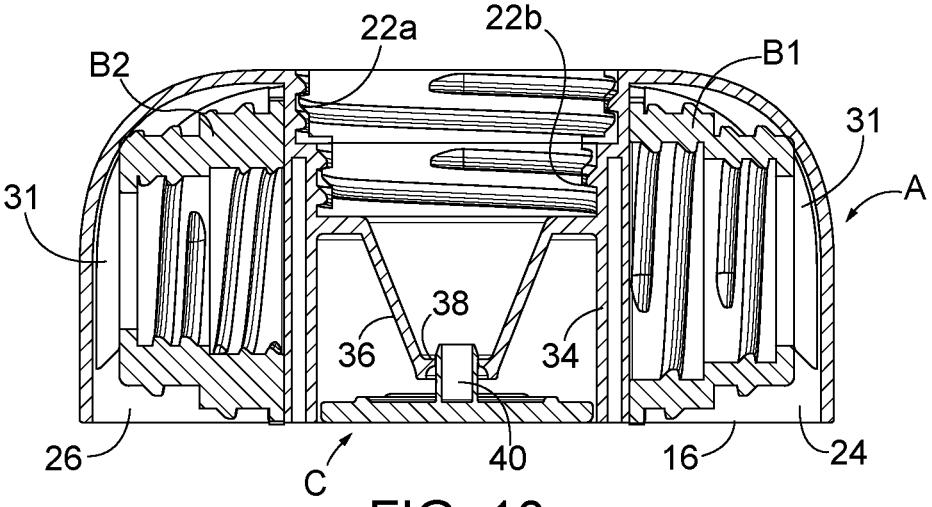
FIG. 18 is a cross-sectional view of the base in the inverted position with adapters in the base compartments.
Figure 19:
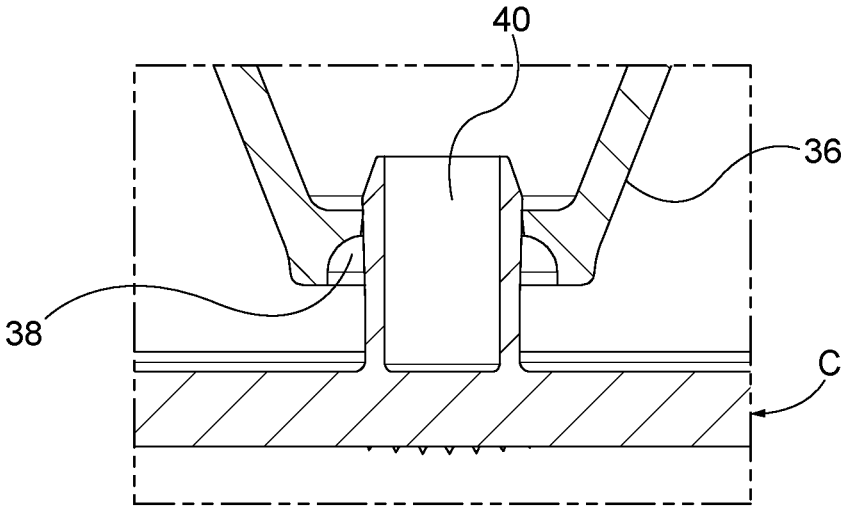
FIG. 19 is an enlarged view of the base opening port with the lid protrusion received therein.

As best seen in FIGS. 3 and 4, surface 12 of base A has a central opening 22 which is configured to receive an adapter B. As best seen in FIGS. 16 and 18, which are cross-sectional views of base A, the opening 22 is internally threaded in two sections 22*a* and 22*b*. Sections 22*a* and 22*b* are of different sizes, the top section 22*a* being larger in diameter that section 22*b*. Thus opening 22 is capable of receiving bottles with two different neck sizes.

Figure 17:
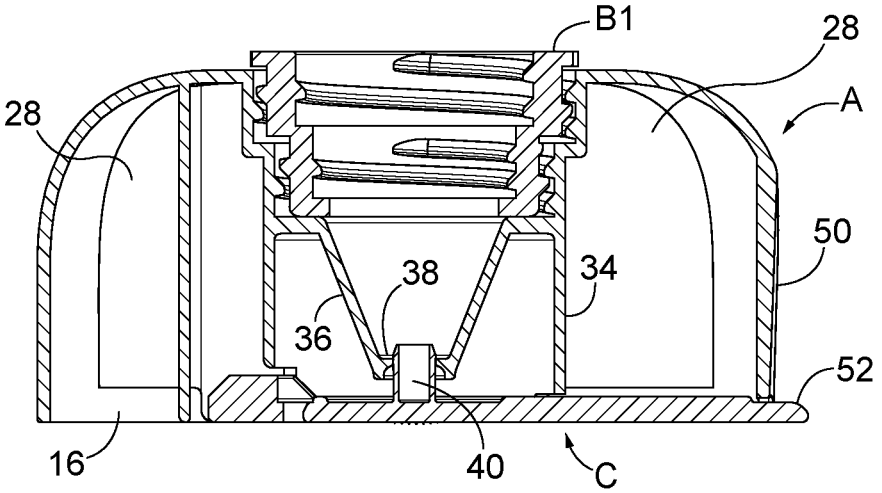
FIG. 17 is a cross-sectional view of the base in the inverted position with an adapter in the base opening.

Alternatively, base opening 22 can receive either of the adapters B1 or B2. FIG. 17 shows the base with adapter B1 situated with opening 22. Each adapter B1, B2 has the same externally threaded exterior having two sections of different size and is structured to be received in opening 22. Thus, either adapter B1 or adapter B2 can be situated in the base opening.

Each adapter B1, B2 has at least two internally threaded sections of different diameter. However, the internally threaded sections of each adapter are different sizes from each other. Moreover, the internally threaded sections of each adapter are different sizes in each adapter and from the internally threaded sections of the base opening 22. Accordingly, adapter B1 can accept two bottles with different size bottle necks and adapter B2 can accept two bottles with different size bottle necks. The adapters B1 and B2 are each designed to accept bottles with different size bottle necks. Therefore, in the preferred embodiment illustrated, the base can accept at least six different bottles with different bottle neck sizes: two bottles in base opening 22, two bottles in adapter B1, when adapter B1 is situated in base opening 22, and two bottles in adapter B2, when adapter B2 is received in base opening 22.

Figure 7:
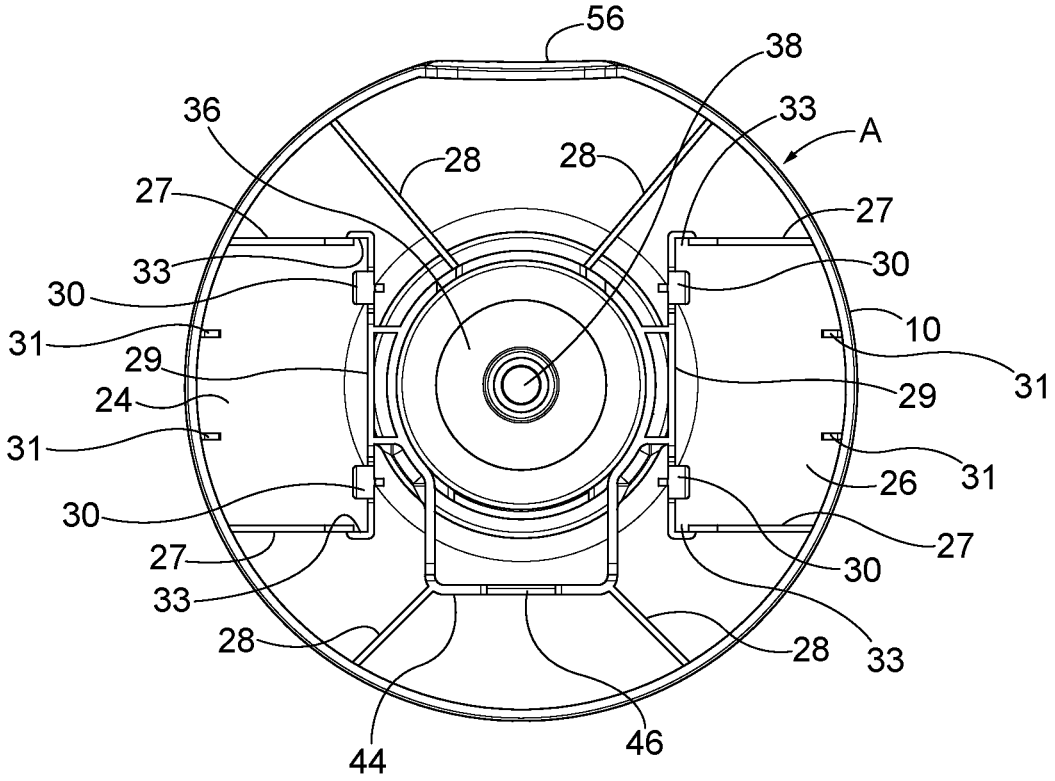
FIG. 7 is a bottom plan view of the base of the cap assembly without the lid showing the base storage compartments.
Figure 8:
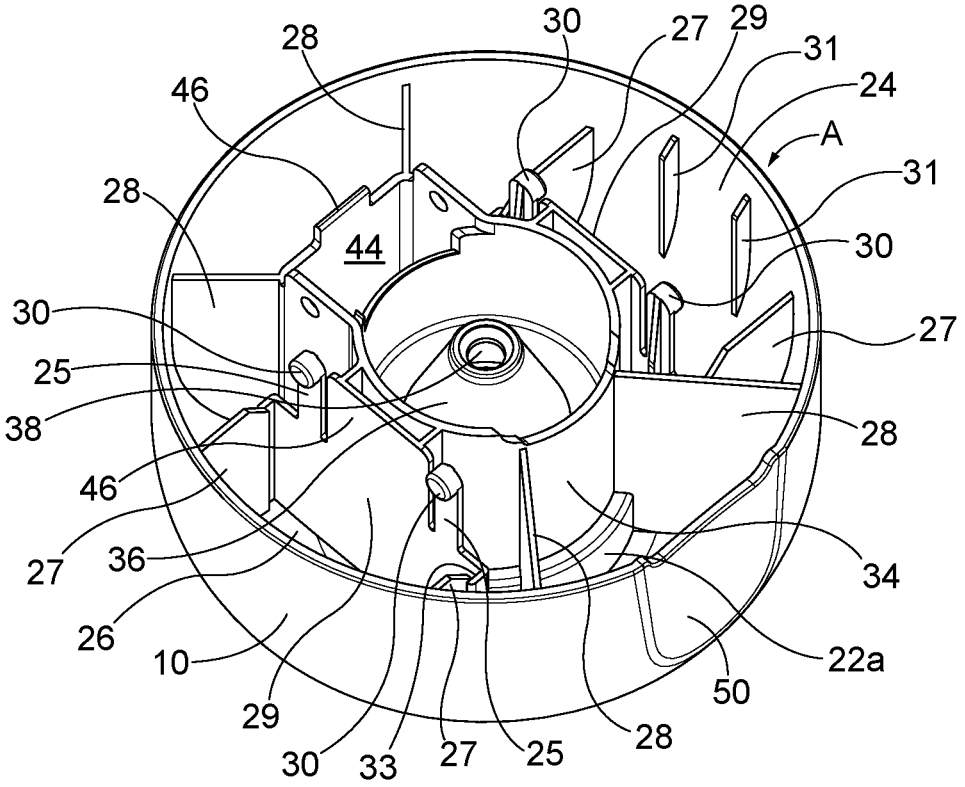
FIG. 8 is a perspective view base of the cap assembly without the lid showing the base storage compartments.
Figure 9:
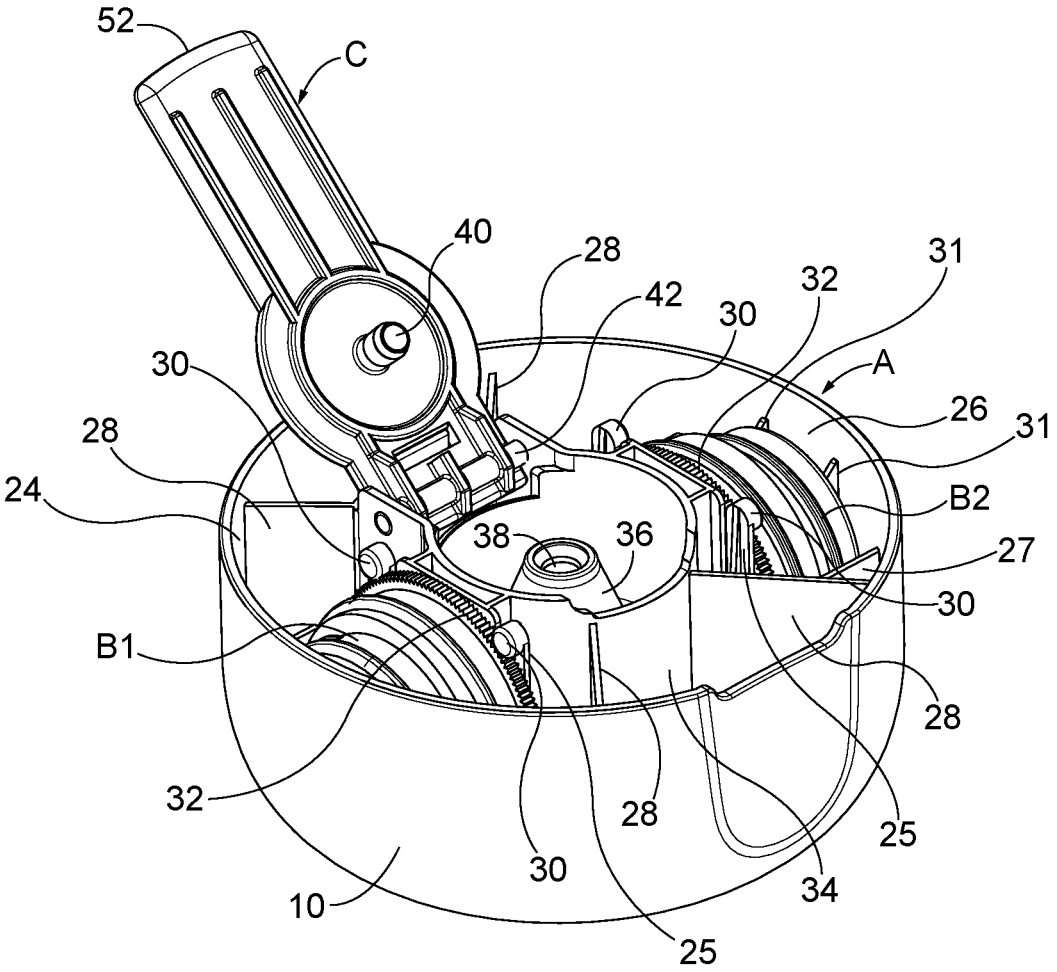
FIG. 9 is a perspective view of the base of the cap assembly with the lid in the open position.
Figure 10:
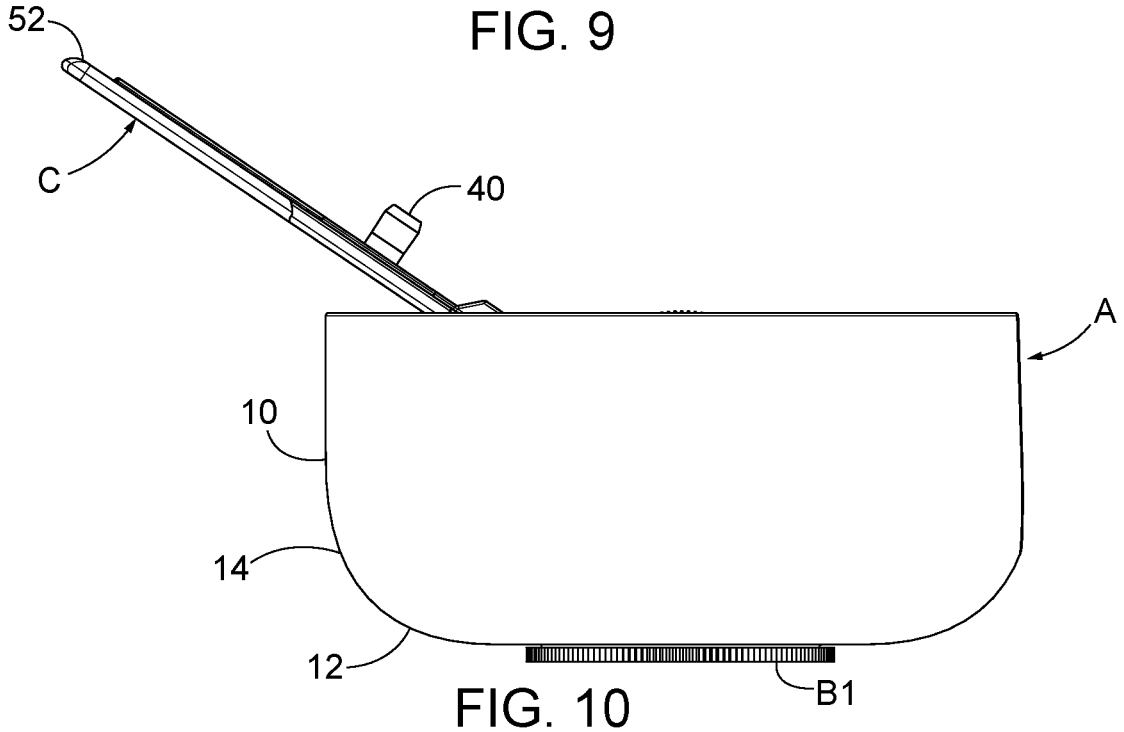
FIG. 10 is a side elevation view base of the cap assembly with the lid in the open position.
Figure 11:
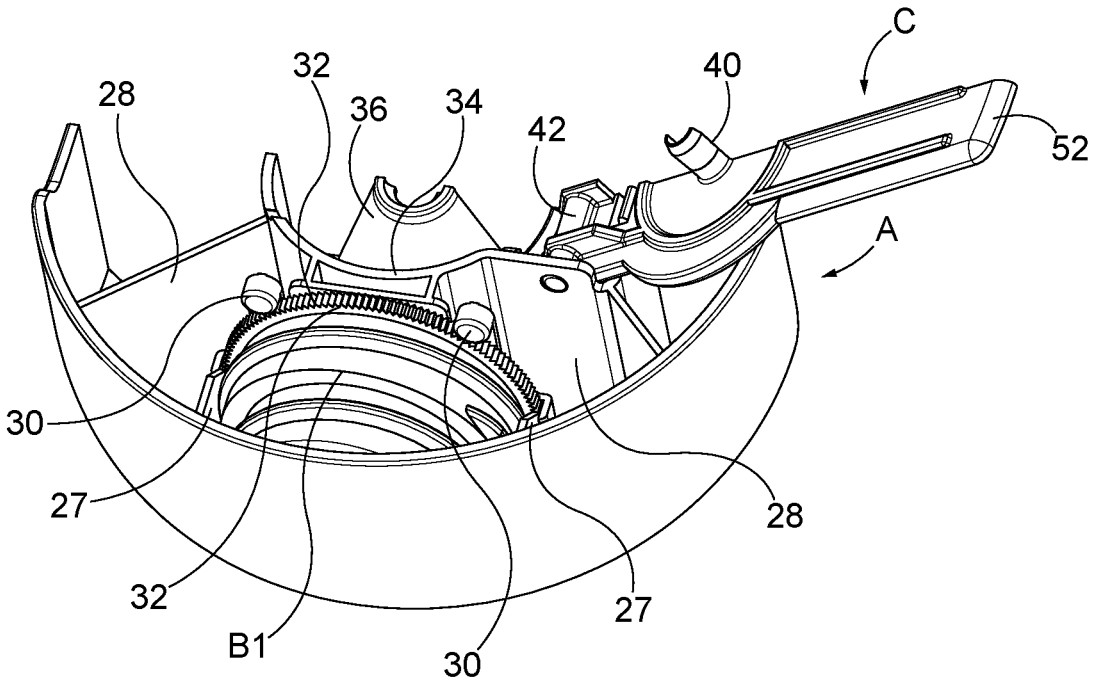
FIG. 11 is a perspective cut-away side view of the base of the present invention showing the lid in the open position.
Figure 12:
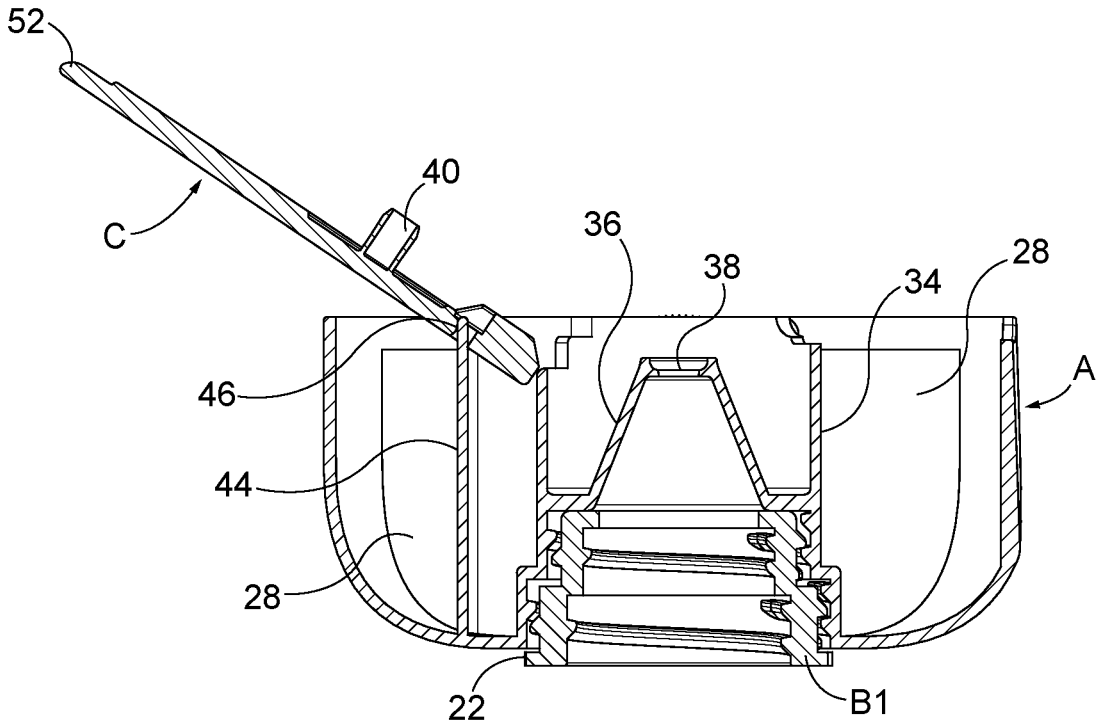
FIG. 12 is a cross-sectional side view of the base of the present invention showing the lid in the open position.

As best seen in FIGS. 7, 8 and 9, base has two compartments 24, 26 for storing adapters B1 and B2 respectively. The adapter storage compartments are each defined between a pair of spaced vertical walls 27 and a wall 29 which connects the inner corners of the walls 27. The bottom of base A is open such that the adapters can be removed and replaced as needed, greatly reducing the possibility that either of the adapters would be lost or misplaced.

As best seen in FIG. 8, wall 29 of each adapter storage compartment 24, 26 includes two flexible fingers, one on each side of the wall. Mounted to the end of each finger 25 is a part 30 which can take the shape of a nub, a pin or a button, as shown. Parts 30 serve to retain the adapter within the compartment when the adapter is not in use. The flexible fingers allow the parts 30 to be moved out of the path of an adapter as the adapter is inserted into the compartment. Once fully seated in the compartment, the flexible fingers return the parts 30 to their original position, over the rim of the adapter so as to secure the adapter within the compartment.

Spaced fins 31, extending inwardly from the interior surface of the side wall 10 of the base of each compartment, further stabilize and secure the adapter in the compartment which lodges between the fins and wall 29.

Preferably, the rim of the top of each adapter has an external edge 32 which is grooved or knurled to provide an enhanced grip when screwing the adapter into the base opening and removing the adapter from the storage compartment. It also provides increased frictional engagement with the parts 30.

Figure 20:
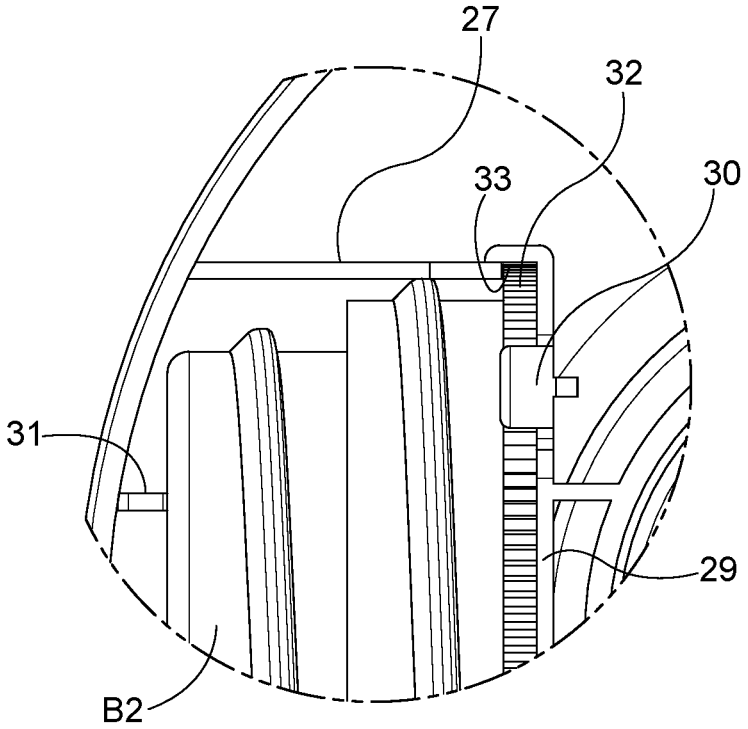
FIG. 20 is an enlarged view of a corner of a base storage compartment showing the part in engagement with an adapter.

Moreover, as best seen in FIGS. 7 and 20, the edge of each wall 27 meets the side of wall 29 in a manner which defines a channel 33. Fins 31 assist in aligning the adapter within the storage compartment such that the rim of the adapter can be received in channel 33 as the adapter is inserted into the compartment. Once the adapter is fully seated within the compartment, channel 33 and fins 31 help secure the adapter within the compartment.

Base A has a central cylindrical wall 34 which includes base opening 22. Vertical walls 28 radially extend from the exterior surface of wall 34 to the interior of side wall 10 of the base. Walls 28 serve to provide additional structural rigidity to the base.

Within cylindrical wall 34 is a funnel 36 which extends from base opening 22 to a port 38. Funnel 36 serves to guide the contents of the bottle attached to the base from base opening 22 to port 38. Lid C includes a cylindrical protrusion 40 extending from the bottom surface of the lid. Protrusion 40 is adapted to be received into and to seal port 38 when lid C is in its closed position, as seen in FIGS. 5, 6, 17, 18 and 19. Protrusion 40 is structured to fit tightly within port 38. It is made of a material which provides a high friction engagement with the port such that the protrusion seals the port and maintains the lid in its closed position such that the application of an external force on the lid is required to withdraw the protrusion from the port to move the lid from its closed position. This avoids accidental opening of the port.

Figure 6:
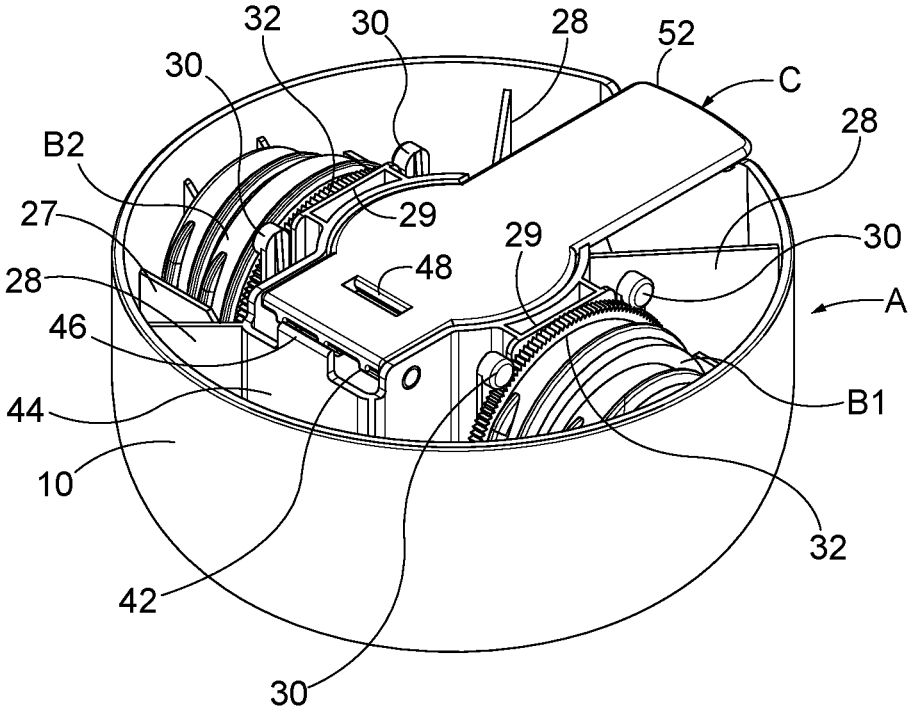
FIG. 6 is a perspective view of the base of the cap assembly showing the base storage compartments and the lid in its closed position.

As best seen in FIGS. 6 and 9, one end of lid C is attached to base A by a hinge which allows the lid to be moved between its closed position, in which the protrusion 40 seals port 38 and an open position, shown in FIGS. 2, 9, 10, 11, 12 and 15, wherein port 38 is open and the contents of the bottle can flow through funnel 36 and out of port 38.

One vertically extending wall 44 of base A has a protruding edge 46 which extends toward lid C. As best seen in FIGS. 5, 6, 13, 14 and 15, lid C has an elongated recess or channel 48 which is situated to align with and accept edge 46 when the lid is in its fully open position.

Figure 13:
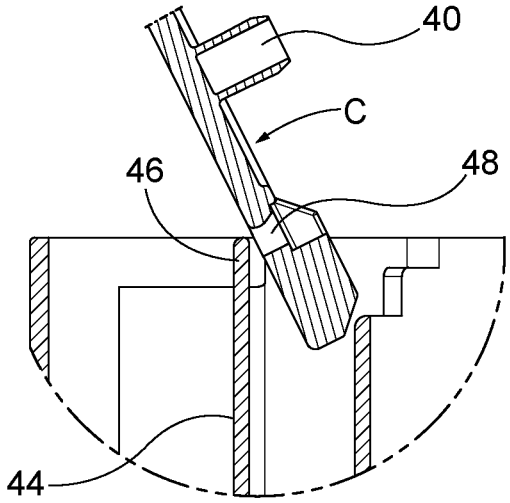
FIG. 13 is a cross-sectional view of the lid and adjacent parts of the base showing the lid before the base protrusion enters the lid recess.
Figure 14:
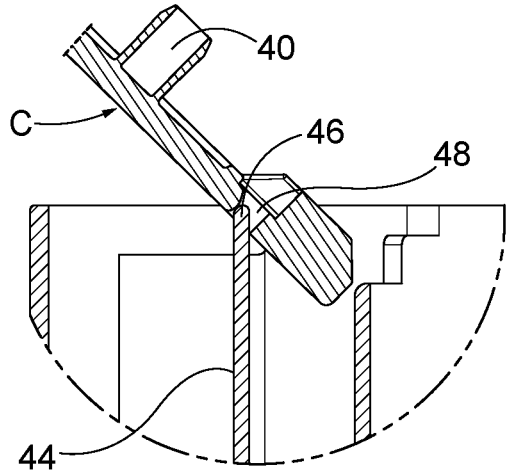
FIG. 14 is a cross-sectional view of the lid and adjacent parts of the base showing the lid as the base protrusion enters the lid recess.
Figure 15:
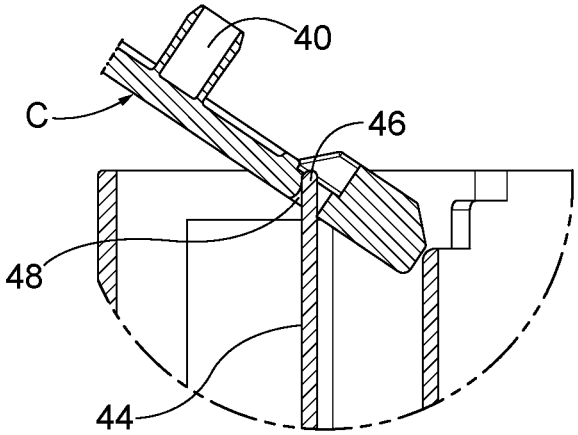
FIG. 15 is a cross-sectional view of the lid and adjacent parts of the base showing the lid after the base protrusion has entered the lid recess.

FIG. 13 shows the lid as it is moved from its closed position toward its open position. FIG. 14 shows the lid as it approaches its open position and edge 46 begins to enter recess 48. FIG. 15 shows lid C in its open most position wherein edge 46 is fully received in recess 48. In its most open position, edge 46 frictionally engages recess 48 to maintain the lid in the open position. An external force must be applied to the lid to overcome the friction force between edge 46 and recess 48 to move the lid from its open position toward its closed position.

Thus, lid C is retained at each of its end positions. It is maintained in its closed position by the frictional engagement of protrusion 40 in port 38. It is maintained in its open position by the frictional engagement of edge 46 in recess 48.

Wall 10 of base A has a recessed portion 50, as best seen in FIG. 3. As best seen in FIG. 4, the tip 52 of the free end of lid C extends beyond the surface of recess 50 and is accessible from the exterior of side wall 10 of the base. This allows the lid to be easily moved between its closed and open positions.

In a preferred embodiment, the base opening 22 may for example have an internally threaded section adjacent surface 12 which is sized to accept a 38 mm diameter bottle neck and an internally threaded section adjacent funnel 36 which is sized to accept a 33 mm bottle neck. Adapter B1 may have a larger internally threaded section sized to receive a 28 mm bottle neck and a smaller internally threaded section sized to receive a 24 mm bottle neck. Adapter B2 may have a larger internally threaded section sized to receive a 22 mm bottle neck and a smaller internally threaded section sized to receive a 20 mm bottle neck. Accordingly, the cap assembly of the present invention can be used with at least six bottles with at least six different bottle neck sizes.

It should now be understood that the present invention relates to a cap assembly having a two section, dual diameter threaded opening adapted to receive and fit one of two different size threaded bottle necks with one motion making it for easy sizing. The cap assembly has a low profile and a storage capacity for at least two adapters each with two internally threaded sections to accommodate additional bottle neck sizes and types (threaded and snap-on).

The exterior wall surface of each adapter has two sections, and dual diameter to fit securely into the cap assembly base opening. The interior surface of each adapter has two sections. The size of each section of each adapter may be different in diameter and in type (threaded, snap-on). The section combinations may include dual or single diameter, both sections threaded, both sections snap-on, or one section threaded and one-level snap-on.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims:

It is intended to cover by the following claims:

1. A cap assembly for use with multiple bottles having different size necks, said assembly comprising a base comprising at least one opening, said base being configured to support a bottle on a surface, at least one adapter and a lid, said base comprising a compartment for storing said at least one adapter when said adapter is not in use such that said at least one adapter may be inserted into and removed from said base storage compartment through said at least one base opening, said base further comprising a surface with an opening, said base surface opening being adapted to receive a bottle neck, and comprising at least two internally threaded sections of different size and a port, said at least one adapter comprising an internally threaded opening having at least two sections of different size and an externally threaded surface and being configured to be received in said base surface opening, said lid being mounted on said base for movement between a position wherein said base opening port is closed and a position wherein said base opening port is open, when said base is remote from said surface.

2. The assembly of claim 1 wherein said sizes of said base opening sections are different from said sizes of said internally threaded sections of said adapter opening.

3. The assembly of claim 1 further comprising a second adapter comprising an internally threaded opening having at least two sections of different sizes and an externally threaded surface having at least two sections of different sizes.

4. The assembly of claim 3 wherein said sizes of said base opening sections, said sizes of said internally threaded sections of said adapter opening and said sizes of said internally threaded sections of said second adapter opening are all different from each other.

5. The assembly of claim 3 wherein said base comprises a second compartment in said base for storing said second adapter.

6. The assembly of claim 1 wherein said base surface opening further comprises a funnel extending between said internally threaded sections of the base surface opening and said port.

7. The assembly of claim 1 further comprising a hinge for connecting said lid to said base.

8. The assembly of claim 1 wherein said lid comprises a protrusion and wherein said protrusion is received in said port in said closed position of said lid.

9. The assembly of claim 1 wherein said base has a partially open bottom and wherein said lid extends over a portion of said partially open base bottom when said lid is in said position wherein said base opening port is closed.

10. The assembly of claim 1 wherein said lid comprises a protrusion and wherein said protrusion is tightly received in said port in said closed position of said lid such that said lid tends to remain in its closed position.

11. The assembly of claim 1 wherein said lid comprises a recess and wherein said base comprises a part adapted to be received in said recess when said lid is in its open position.

12. The assembly of claim 2 further comprising a protrusion which extends from the surface of said lid and is adapted to seal said port.

13. The assembly of claim 1 further comprising at least one part situated in said base compartment adapted to engage said adapter when said adapter is stored within said base compartment.

14. The assembly of claim 1 wherein said base has a substantially cylindrical side wall surface and a substantially flat top surface portion.

15. The assembly of claim 14 wherein said base side wall surface and said base top surface portion are connected by an arcuate surface portion.

16. The assembly of claim 1 wherein said lid has an edge which is accessible from the exterior of said base when said lid is in the closed position.

17. The assembly of claim 1 wherein said adapter has a rim and wherein said compartment comprises a channel adapted to receive said adapter rim.

18. The assembly of claim 1 wherein said adapter has a rim and further comprising a part flexibly mounted to move out of the path of said adapter as said adapter is received in said compartment and thereafter engage said adapter rim to secure said adapter within said compartment.

19. The assembly of claim 1 wherein said compartment comprises an inner wall and an outer wall, and further comprises at least one fin extending from one of said compartment walls toward said other of said compartment walls, wherein said adapter is received between said fin and said other of said compartment walls.

20. A cap assembly adapted for use with at least four bottles having different size necks, said assembly comprising a base configured to support a bottle on a surface, at least one adapter and a lid, said base comprising opening comprising at least two internally threaded sections of different size adapted to receive two different size bottle necks and a port, said at least one adapter comprising an internally threaded opening having at least two sections of different sizes adapted to receive two other bottles and an externally threaded surface such that said adapter can be received in said base opening, said lid being mounted on said base for movement between a position wherein said base opening port is closed and a position wherein said base opening port is open.

21. A cap assembly adapted for use with at least six bottles having different size necks, said assembly comprising a base configured to support a bottle on a surface, a first adapter and a lid, said base comprising an opening comprising at least two internally threaded sections of different size adapted to receive two of the bottles and a port, said first adapter comprising an internally threaded opening having at least two sections of different size adapted to receive two other bottles and an externally threaded surface such that said adapter can be received in said base opening, a second adapter comprising an internally threaded opening having at least two sections of different size adapted to receive the remaining two bottles and an externally threaded surface such that said second adapter can be received in said base opening or said first adapter opening, said lid being mounted on said base for movement between a position wherein in said base opening port is closed and a position wherein said base opening port is open.

22. A cap assembly for use with multiple bottles having different size necks, said assembly comprising a base, at least one adapter and a lid, said base comprising a compartment for storing said at least one adapter and an opening comprising at least two internally threaded sections of different size and a port, said at least one adapter comprising an internally threaded opening having at least two sections of different sizes and an externally threaded surface having at least two sections of different sizes, said lid being mounted on said base for movement between a position wherein said base opening port is closed and a position wherein said base opening port is open, further comprising a second adapter comprising an internally threaded opening having at least two sections of different sizes and an externally threaded surface having at least two sections of different sizes, wherein said base comprises a second compartment for storing said second adapter.

23. A cap assembly for use with multiple bottles having different size necks, said assembly comprising a base, at least one adapter and a lid, said base comprising a compartment for storing said at least one adapter and an opening comprising at least two internally threaded sections of different size and a port, said at least one adapter comprising an internally threaded opening having at least two sections of different sizes and an externally threaded surface having at least two sections of different sizes, said lid being mounted on said base for movement between a position wherein said base opening port is closed and a position wherein said base opening port is open, wherein said lid comprises a recess and wherein said base comprises a part adapted to be received in said recess when said lid is in its open position.

24. A cap assembly for use with multiple bottles having different size necks, said assembly comprising a base, at least one adapter and a lid, said base comprising a compartment for storing said at least one adapter and an opening comprising at least two internally threaded sections of different size and a port, said at least one adapter comprising an internally threaded opening having at least two sections of different sizes and an externally threaded surface having at least two sections of different sizes, said lid being mounted on said base for movement between a position wherein said base opening port is closed and a position wherein said base opening port is open, wherein said adapter has a rim and wherein said compartment comprises a channel adapted to receive said adapter rim.

25. A cap assembly for use with multiple bottles having different size necks, said assembly comprising a base, at least one adapter and a lid, said base comprising a compartment for storing said at least one adapter and an opening comprising at least two internally threaded sections of different size and a port, said at least one adapter comprising an internally threaded opening having at least two sections of different sizes and an externally threaded surface having at least two sections of different sizes, said lid being mounted on said base for movement between a position wherein said base opening port is closed and a position wherein said base opening port is open, wherein said adapter has a rim and further comprising a part flexibly mounted to move out of the path of said adapter as said adapter is received in said compartment and thereafter engage said adapter rim to secure said adapter within said compartment.

26. A cap assembly for use with multiple bottles having different size necks, said assembly comprising a base, at least one adapter and a lid, said base comprising a compartment for storing said at least one adapter and an opening comprising at least two internally threaded sections of different size and a port, said at least one adapter comprising an internally threaded opening having at least two sections of different sizes and an externally threaded surface having at least two sections of different sizes, said lid being mounted on said base for movement between a position wherein said base opening port is closed and a position wherein said base opening port is open, wherein said compartment comprises an inner wall and an outer wall, and further comprises at least one fin extending from one of said compartment walls toward said other of said compartment walls, wherein said adapter is received between said fin and said other of said compartment walls.

27. A cap assembly for use with multiple bottles having different size necks, said assembly comprising a base configured to support a bottle on a surface, at least one adapter and a lid, said base comprising a surface with an opening adapted to receive a bottle neck and support a bottle, said base surface opening comprising at least two internally threaded sections of different size and a port, said at least one adapter comprising an internally threaded opening having at least two sections of different size and an externally threaded surface configured to be received in said base surface opening, said lid being mounted on said base for movement between a position wherein said base opening port is closed and a position wherein said base opening port is open, when said base is remote from said surface.

28. The assembly of claim 27 wherein said base comprises a compartment configured to store said at least one adapter and an opening through which said at least said adapter may be received in and removed from said compartment.

29. A cap assembly for use with a bottle with a neck, said assembly comprising a base comprising at least one opening, said base being configured to support a bottle on a surface, at least one adapter and a lid, said base comprising a compartment for storing said at least one adapter when said adapter is not in use, such that said at least one adapter may be inserted into and removed from said base storage compartment through said at least one base opening, said base further comprising a surface with an opening, said base surface opening being adapted to receive the bottle neck, said lid being mounted on said base for movement between a position wherein said base opening port is closed, and a position wherein said base opening port is open when said base is remote from said surface.

* * * * *